United States Patent [19]

Harrington et al.

[11] Patent Number: 4,492,337

[45] Date of Patent: Jan. 8, 1985

[54] METAL SPRAY

[75] Inventors: Kent W. Harrington, Pembroke; John L. Stevens, Dunbarton; Merle L. Thorpe, Hopkinton, all of N.H.

[73] Assignee: TAFA Incorporated, Bow, N.H.

[21] Appl. No.: 470,071

[22] Filed: Feb. 28, 1983

[51] Int. Cl.[3] ..... B05B 1/24

[52] U.S. Cl. ..... 239/81; 239/84; 219/76.14

[58] Field of Search ..... 239/79, 80, 81, 83, 239/84; 219/76.14, 76.16, 121 PL, 121 PS

[56] References Cited

U.S. PATENT DOCUMENTS

| | | | |
|---|---|---|---|
| 2,040,030 | 5/1936 | Snyder et al. | 239/84 X |
| 2,749,176 | 6/1956 | Steyer | 239/80 |
| 2,876,330 | 3/1959 | Reinhardt | 219/76 |
| 3,141,616 | 7/1964 | Cauchetier | 239/81 |
| 3,312,566 | 4/1967 | Winzeler et al. | 117/93.1 |
| 3,546,415 | 12/1970 | Marantz | 219/76 |
| 3,632,952 | 1/1972 | Rotolico | 219/76 |
| 3,798,411 | 3/1974 | Wagner | 219/136 |
| 4,024,369 | 5/1977 | Thompson et al. | 219/76 |
| 4,078,097 | 3/1978 | Miller | 427/34 |
| 4,095,081 | 6/1978 | Ashman | 239/81 X |
| 4,128,754 | 12/1978 | Rathjen | 219/137 |

FOREIGN PATENT DOCUMENTS

| | | | |
|---|---|---|---|
| 0119618 | 9/1947 | Sweden | 239/84 |

*Primary Examiner*—John J. Love
*Assistant Examiner*—Mary F. McCarthy

[57] ABSTRACT

A metal spray gun of the arc spray type has a nozzle-positioner member of electrically insulating material that is disposed between a gas inlet and an arc zone. A primary stream of gas is flowed through a through passage in the nozzle-positioner member, and seat surfaces in the through passage receive tips of individual electrically conductive contact tube assemblies that are biased outwardly away from one another. The nozzle-positioner member aligns the contact tube assemblies and configures the gas stream such that each metal wire is immediately enveloped in gas flow as it emerges from its contact tube and remains in that enveloping gas flow throughout the region between the contact tube tip and the arc zone. The spray gun produces quality metal spray coatings with lower gas pressures and has lower noise levels.

19 Claims, 14 Drawing Figures

FIG 3
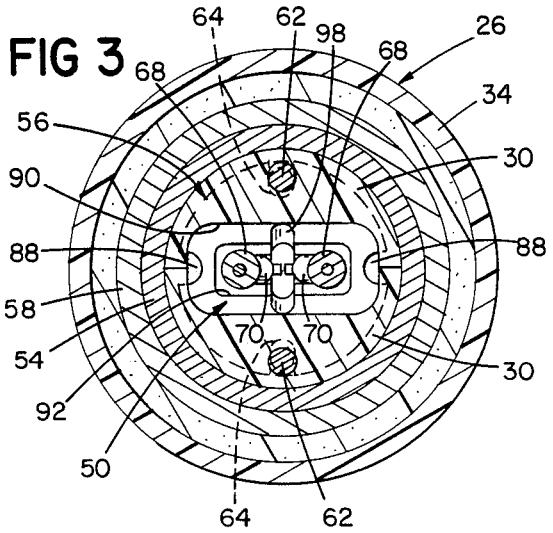
FIG 7
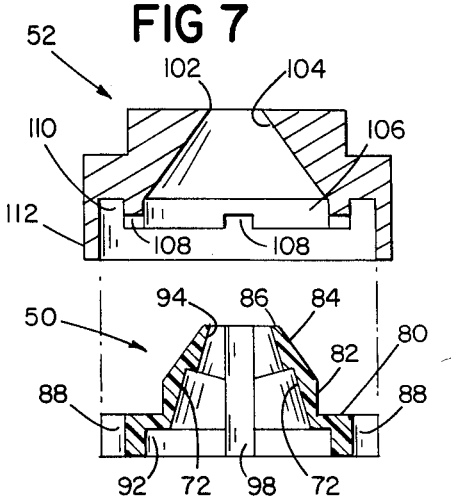
FIG 4
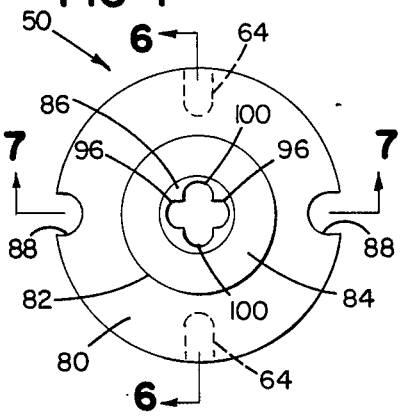
FIG 6
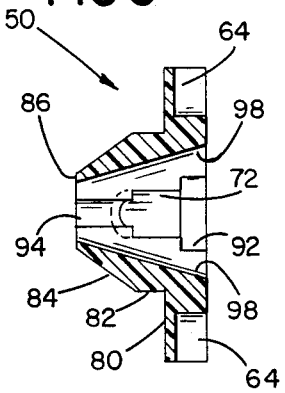
FIG 5
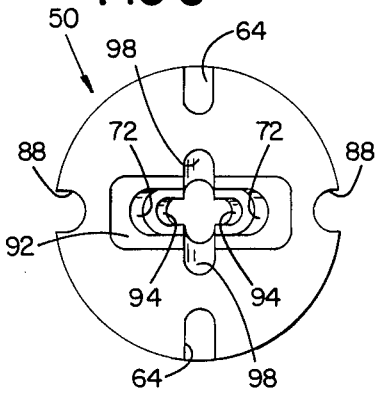
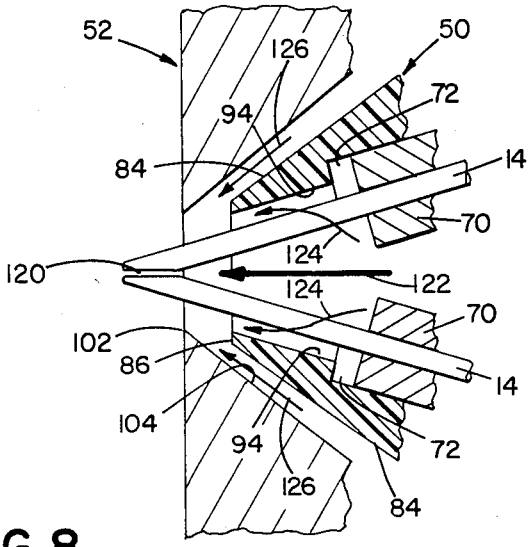
FIG 8
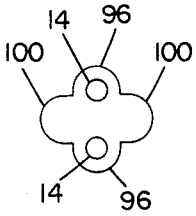
FIG 9A
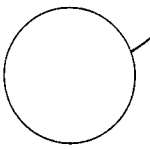
FIG 9B
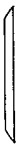
FIG 9C
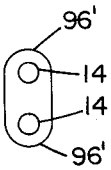
FIG 10A
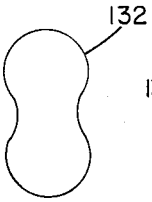
FIG 10B
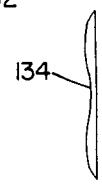
FIG 10C

METAL SPRAY

This invention relates to metal spraying devices, and more particularly to metal spray devices of the arc spray type in which the ends of two metal wires are melted in an electric arc and resulting molten metal particles are sprayed onto a work piece to be coated.

Electric arc metal spray guns are well known in the art. In such metal spray guns, two metal wires or the like are simultaneously fed along converging paths into a stream of compressed air or other noncombustible gas and an electric potential across the wires produces an arc which melts the wire with the resulting metal droplets being carried from the arc zone by the gas stream. Difficulties are encountered in maintaining the desired accurate relationship between the wires and the gas stream. Misalignment of the wires or displacement of the arc zone relative to the gas stream can produce unsatisfactorily results such as wide particle size distribution, or intermittent arcing, which produce nonuniform and poor quality coatings. Numerous proposals have been made to provide improved wire guidance and gas stream alignment, but these efforts have not been entirely satisfactory. Such proposals include the use of a ceramic wire guide in front of the nozzle with converging passages which guide the wire from the contact tubes as shown in U.S. Pat. No. 4,095,081; and the seating of contact tubes on an air nozzle as shown in U.S. Pat. No. 4,024,369.

In accordance with one aspect of the invention, there is provided in a metal spray gun of the arc spray type, alignment structure of electrically insulating material that defines a through passage. The alignment structure is disposed between a gas inlet and an arc zone such that a primary stream of gas flows through the through passage. Seat surfaces in the through passage receive tips of individual electrically conductive wire guides, those wire guide tips being urged outwardly away from one another and seated on the seat surfaces. The alignment structure supports the wire guides and configures the gas stream such that each metal wire is immediately enveloped in gas flow as it emerges from the wire guide and remains in that enveloping gas flow throughout the region between the wire guide tip and the arc zone.

Preferably, the wire guides are elongated contact tube members that are disposed in a chamber with the alignment structure being seated on a front surface of the chamber defining structure and aligning the tips of the wire guides. The rear ends of the contact tubes extend through cooperating alignment apertures in the rear wall of the chamber and are connected to terminal structures external to the chamber structure in a floating arrangement such that the wire guides have a degree of freedom of axial and angular movement while the alignment structure maintains accurate wire-arc zone-gas stream alignment.

In a particular embodiment, the alignment structure is a unitary nozzle-positioner member that is molded of aluminum filled epoxy and defines a converging through passage with the wire guide seats formed therein. Each wire guide includes a copper tube and a replaceable end that includes a cylindrical tip portion. The nozzle-positioner member is releasably seated against the front wall of the chamber and, upon removal of the nozzle member and release of the terminals, each contact tube assembly may be withdrawn forwardly through the gas chamber and its outlet port for tip replacement or other maintenance as desired.

A cylindrical housing receives the nozzle-positioner member in an arrangement such that the angular (rotational) position of the nozzle-positioner member may be adjusted relative to the gun axis such that the seat surfaces of the positioner member are accurately aligned with contact tube support surfaces to provide accurate wire feed alignment. An air cap - arc shield assembly secures the nozzle-positioner member on the chamber structure and provide a supplemental annular flow passage that extends around the nozzle-positioner member for flowing supplemental gas over the outside of the nozzle member in an annular converging stream towards the arc zone. In one embodiment, the forwardly convergent passage of the nozzle-positioner member terminates in an elongated orifice such that the spray gun system provides a lozenge-shaped spray pattern, while in another embodiment, the nozzle orifice has two opposed supplemental lobes that provide gas flow above and below the converging wires and the system provides a spray pattern of generally circular configuration. The size and shapes of the flow passages may be changed to vary the size and distribution of the sprayed particles. In the case of spraying aluminum and zinc, for example, fine particle sizes are desirable to produce a dense and fine textured coat for improved corrosion protection, and also to provide fine detail in mold reproduction applications. Particle size can also be varied by varying the gas pressure or the air cap orifice diameter. The system permits achievement of the same atomization characteristics as prior art spray guns, of the type shown in U.S. Pat. No. 4,095,081 for example, with lower air pressures—a pressure of forty psi with stainless steel wire achieving the same equivalent coating as a pressure of sixty psi with a spray gun of the type shown in U.S. Pat. No. 4,095,081. Such lower air pressures permit use of economical, better regulated air sources and also reduce noise levels (about five decibels). Even finer sprays are produced with higher gas pressures.

The invention provides an improved arc spray gun with a simple alignment arrangement which facilitates alignment of the atomizing gas stream, the wires and the guide tubes relative to the arc zone, permits variation in particle size and spray patterns, and operation at lower noise levels and with lower gas pressures.

Other features and advantages of the invention will be seen as the following description of particular embodiments progresses, in conjunction with the drawings, in which:

FIG. 3 is a sectional view taken along the line 3—3 of FIG. 2;

FIG. 4 is a front view of the nozzle-positioner member employed in the spray gun shown in FIG. 1;

FIG. 5 is a rear view of the nozzle-positioner member shown in FIG. 4;

Figure 1:
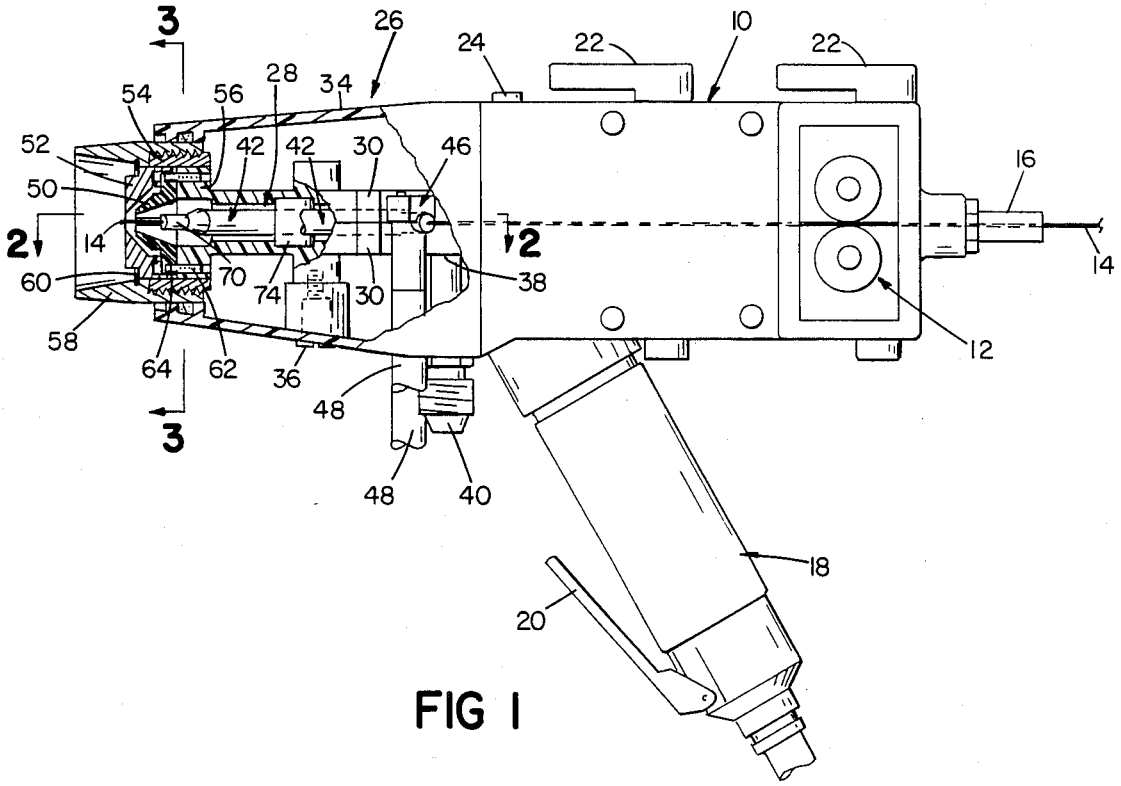
FIG. 1 is a side view, with parts broken away, of an arc spray gun in accordance with the invention.

FIGS. 6 and 7 are sectional views taken along the lines 6—6 and 7—7 respectively of FIG. 4, a corresponding sectional view of the cooperating cap member also being shown in FIG. 7;

FIG. 8 is a diagrammatic view of wire feed and air flow paths in the arc spray gun of FIG. 1;

FIG. 9 (A, B, C) is a diagrammatic indication of the spray pattern and coating configuration obtained with the nozzle-positioner member of FIGS. 4–7; and FIG. 10 (A, B, C) is a diagrammatic indication of the spray pattern and coating configuration obtained with another nozzle-positioner member.

DESCRIPTION OF PARTICULAR EMBODIMENTS

The spray gun shown in FIG. 1 includes a drive unit 10 that has drive assemblies 12 on either side thereof for advancing wire 14 that is fed through inlet tubes 16. Air motor 18 is mounted on housing 10 and is controlled by lever 20 that drives a shaft (not shown) which in turn drives the two wire drive assemblies. Levers 22 control the drive assemblies and push buttons 24 control atomizing air flow and voltage to the wires.

Secured to the forward end of drive unit 10 by plate 25 is spray head assemblies 26, within which is disposed chamber structure 28 formed by similar upper and lower molded members 30 of electrically insulating material (aluminum filled epoxy) that are glued and bolted together with fasteners 32. Cover 34 is secured to chamber 28 with fastener 36. The chamber defined by structure 28 has an inlet 38 for compressed air which is supplied via coupling 40. Two guide tube assemblies 42 extend through chamber 28 and are supported by apertures 44 (FIG. 2) at the rear of the chamber Releasably attached to the rear end of each tube assembly 42 is a terminal block assembly 46 that is connected to a power supply conductor 48. The front end of each guide tube assembly 42 is received in nozzle-positioner member 50 that is seated against the chamber outlet port at the forward end of the chamber structure 28. Nozzle-positioner member 50 is disposed within metal air cap 52. A metal ring 54 is fastened over cylindrical boss 56 at the forward end of chamber 28, and arc shield 58 that is threadedly secured on ring 54 carries retaining ring 60 (FIG. 2) which is seated against air cap 52 to seat the alignment and air cap members 50, 52 against the front wall of the chamber assembly. Alignment posts 62 project forwardly from boss 56 and engage recesses 64 in nozzle-positioner member 50. The rotational position of member 50 relative to the wire feed plane as defined by guide tube assemblies 42 and their support apertures 44 may be adjusted by adjustment of alignment posts 62.

Figure 2:
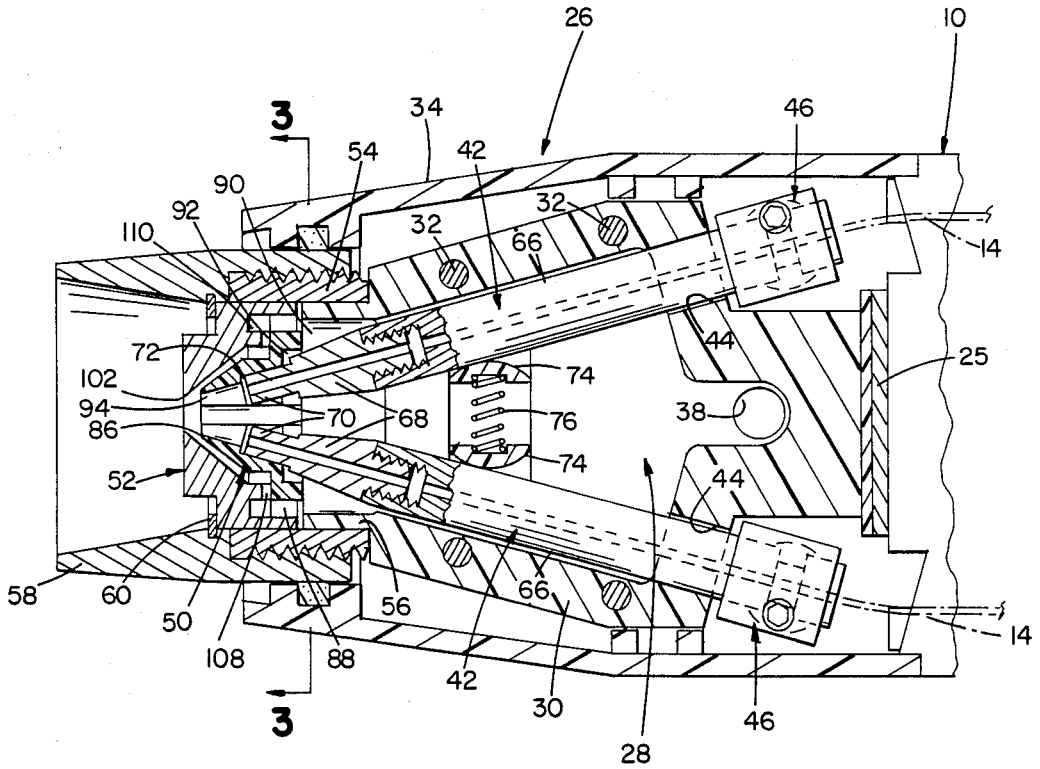
FIG. 2 is a sectional view taken along the line 2—2 of FIG. 1.

Further details of spray head assemblies 26 may be seen with reference to FIGS. 2 and 3. Each wire guide assembly 42 includes a cylindrical copper contact tube 66 and a brass contact tip 68 that is threadedly attached to tube 66 and that has a cylindrical tip portion 70. The rear end of each copper contact tube 66 extends through support aperture 44 at the rear of chamber 28 and is attached to terminal block 46; and the cylindrical end portion 70 of each brass contact tip is received in a seat recess 72 in nozzle-positioner member 50. A biasing assembly which includes electrically insulating shoes 74 and spring 76 acts against the contact tube assemblies 42 to pivot each outwardly about a surface of its support aperture 44 and to seat each cylindrical tip 70 firmly in a recess 72 in nozzle-positioner member 50, thus providing accurate angular positioning while permitting axial movement of each contact tube assembly 42 relative to support seats 44 and 72.

Further details of nozzle-positioner member 50 may be seen with reference to FIGS. 4–7. Member 50 is molded of high temperature aluminum filled electrically insulating epoxy and has a cylindrical flange 80 that is about three centimeters in diameter and slightly less than one-half centimeter in thickness, and a body that has an axial length of about one centimeter with a cylindrical intermediate portion 82 that is about 1.7 centimeters in diameter and a conical forward portion 84 that tapers to end surface 86 at an angle of about 35°. Formed at the periphery of flange 80 are two air passages 88 and two blind alignment recesses 64. Each recess 64 is adapted to receive the projecting positioning stub of an alignment post 62 carried by boss 56. Formed in the rear wall of flange 80 is a rectangular recess 92 that is about two centimeters long, about 0.8 centimeter wide and about 0.2 centimeter deep. Seats 72 (FIGS. 5 and 7) for the contact tips 70 extend forward from recess 92, each seat 72 being of semi-cylindrical configuration with a diameter of about five millimeters and a length of about seven millimeters and being disposed at an angle of about fifteen degrees to the axis of member 50. Forward of and aligned with each seat 72 is a channel 94 that terminates in the end face 86 of member 50 and defines orifice lobe 96 in that face, each channel 94 being of semi-cylindrical configuration of about three millimeters diameter and about five millimeters length and likewise being disposed at an angle of about fifteen degrees to the axis. At the center of each side wall of the rectangular recess 92 and extending forwardly therefrom at an angle of about fifteen degrees to the axis of member 50 is a channel 98 of dimensions similar to those of groove 94. Each channel 98 extends from the rear wall of flange 80 to the front surface 86 forming an orifice lobe 100 as indicated in FIG. 4 such that the nozzle orifice is of four-leaf clover configuration.

Air cap 52, as indicated in FIG. 7, defines an outlet port 102 and includes a tapered surface 104 that extends rearwardly from port 102 to cylindrical surface 106 in which are disposed series of ports 108 which communicate with annular chamber 110. Projecting rearwardly from chamber 110 is cylindrical flange 112 which receives flange 80 of nozzle-positioner member 50.

When the assembly of nozzle-positioner member 50 and air cap 52 is inserted into support ring 54, flange 80 is seated against boss 56 that defines the outlet port 90 of chamber 28, the rotational position of nozzle-positioner member being determined by the projecting stubs of alignment posts 62. (Each post 62 has a shank that is eccentric to its stub and that is received in boss 56. One or both of the alignment posts 62 may be adjusted to rotate member 50 in cap 52 and accurately align recess 72 of nozzle-positioner member 50 with the plane of the guide tube assemblies 42—that is the center lines of the contact tubes are in the same plane. This adjustment is made during manufacturing assembly and posts 62 are then locked in place.) Air cap surface 104 cooperates with nozzle-positioner member surface 84 to define an annular converging air flow passage, the subassembly of cap 52 and member 50 being secured against boss 56 by ring 60 of arc shield 58.

Prior to operating the gun, the leading ends of wires 14 are fed through the wire drive assemblies 12 and into the spray head chamber 28 and through guides 42 until the leading ends of the wires 14 protrude from the end 70 of each contact tube assembly 42. The contact tubes 42 are guided in bores 44 and biased outward by the biasing assembly of shoes 74 and spring 76 such that the cylindrical contact tips 70 are firmly seated in seat channels 72 and the wires fed from those tips are directed along converging paths in accurate alignment with the spray gun axis towards the intersection point 120 for melting in the arc between the two wires and entrainment as fine molten droplets in the air flow pattern. As indicated above, each downstream semi-circular flow passage 94 has a diameter of about three millimeters and each wire 14 (typically in the range of 1–2.3 millimeters in diameter) is fed coaxially through groove 94 but is not supported beyond contact tip 70 such that the wire 14 does not touch the nozzle-positioning member 50. Thus the nozzle-positioning member is not subject to excessive heating or wear due to friction or wire arcing conditions. The contact assemblies 42 are easily accessible by removing cover 34, releasing the terminal blocks 46, unscrewing the arc shield 58, and removing the air cap nozzle-positioner member assembly. Each wire guide assembly 42 may be slid forwardly through the chamber outlet port 90 in boss 56. After replacement of the contact tips 68 or other maintenance, the contact assemblies 42 are inserted through the chamber ports and reconnected to the terminal blocks 46.

To operate the gun, after the feedrollers 12 are closed by levers 22, start button 24 is depressed to supply air to chamber 28 via coupling 40 and to supply power to the contact assemblies 42 via terminal blocks 46. As indicated in FIG. 8, the wires 14 as they emerge from the contact tips 68, are directed towards a point of intersection 120 slightly forward of air cap 52 where an electric arc, due to the current flow through the wires, melts the wires. Air flows into chamber 28 through port 38 and exits principally through nozzle-positioner member 50 in a primary jet 122 directed at arc zone 120. Supplemental air flows 124 in channels 94 envelop the forward end of each wire 14 that protrudes from its contact tip 68. The air flows 122, 124 across the contact tips 68 and around the wires 14 and along the grooves 94 and 98 provide cooling to the nozzle-positioner member 50 and increase its life. Additionally, a converging sheath 126 of air flows towards the arc zone 120 through the passage between surfaces 84 and 104. The interaction of these air streams provides controlled atomization and flow of molten metal particles from the arc zone 120 towards the substrate on which the molten particles are deposited in the metal spraying operation.

Depression of lever 20 starts the wire feeding and spraying operation. To stop spraying, hand control lever 20 is released. Depression of the stop button 24 turns off the air and power flows. During spraying, air flows through the rectangular port 92 and converging channels 94 and 98 such that the forward ends of wires 14 (unsupported from the ends of contact tips 68) are enveloped in air streams that emerge from lobes 96, as indicated in FIGS. 4, 5 and 8.

With the nozzle orifice configuration shown in FIGS. 4–7 and 9A, the high velocity flows of air that surround the wires 14 produce a generally circular spray pattern 130 as indicated diagrammatically at FIG. 9B and deposition of generally uniform thickness as indicated diagrammatically at FIG. 9C. A modified nozzle orifice in member 50, as indicated in FIG. 10A, (without flow passages 98 and orifice lobes 100), produces a lozenge shaped spray pattern 132 (FIG. 10B) with a somewhat reduced deposition thickness 134 in the center of the spray pattern (FIG. 10C). An elongated spray pattern is obtained with a nozzle orifice of slightly greater width. The spray pattern configuration, particle size and density may be varied by appropriate selection of nozzle orifice configuration and gas flow, depending on the particular application. The system has a reduced noise level—about four db less than comparable commercially available spray guns, thus providing a more comfortable operating environment for the operator as well as other personnel in the vicinity of the spraying operation.

While particular embodiments of the invention have been shown and described, various modifications will be apparent to those skilled in the art and therefore it is not intended that the invention be limited to the disclosed embodiment or to details thereof, and departures may be made therefrom within the spirit and scope of the invention.

What is claimed is:

1. A metal spray device of the arc spray type that includes a body, individual wire guides for each wire to be sprayed, means for feeding a wire through each wire guide, unitary alignment structure of electrically insulating material that defines a through passage that terminates in a discharge orifice, seat surfaces on the walls of said through passage, means for urging the tips of said wire guides outwardly away from one another to seat the tips of said wire guides on said seat surfaces, said wire guides being positioned to direct the wires fed through said guides to a point of intersection forward of said seat surfaces, means for connecting said wire guides to a source of electric current for establishing an electric arc between the ends of the wires adjacent said point of intersection, and a gas inlet passage for flowing a stream of gas through said through passage of said alignment structure and into the arc zone to cause molten metal particles to be carried from the arc zone, said alignment structure being arranged such that gas flow envelops the wires throughout the region between the ends of said wire guides and said arc zone.

2. The device of claim 1 and further including cap structure in juxtaposition to and cooperating with said alignment structure to define an annular converging passage that has an apex adjacent said arc zone.

3. The device of claim 1 and further including support for said alignment structure that permits rotational adjustment of said alignment structure such that said wires are fed to said arc zone along paths that are in the plane of said wire guides.

4. The device of claim 1 wherein each said wire guide includes an elongated electrically conductive tubular member and further including chamber defining structure that has a gas inlet, a gas outlet at its forward end, and two tubular member support ports at its rear end, each said tubular member being disposed in said chamber with the rear portion of each said tubular member extending through a corresponding support port for releasable connection to a terminal assembly external of said chamber defining structure, and means to seat said alignment structure against said forward end of said chamber defining structure such that said through passage is in communication with said gas outlet when the tips of said tubular wire guides are seated on said seat-surfaces of said alignment structure.

5. The device of claim 1 wherein said alignment structure is a unitary member and further including cap structure in juxtaposition to and cooperating with said alignment member to define an annular converging passage that has an apex adjacent said arc zone, and support for said alignment member that permits rotational adjustment of said alignment member such that said wires are fed to said arc zone along paths that are in the plane of said wire guides.

6. The device of claim 5 and further including supplemental gas flow channels in said alignment member between the tips of said wire guides.

7. The device of claim 1 wherein said seat surfaces are of semicylindrical configuration and said wire guides have cylindrical tips that are seated in said semicylindrical seat surfaces and have a degree of freedom of axial movement along said seat surfaces, and said alignment structure further includes semicylindrical channel structures that are coaxial with said semicylindrical seat surfaces and extend between said seat surfaces and said discharge orifice.

8. The device of claim 7 wherein said alignment structure is a unitary member of plastics material.

9. The device of claim 8 wherein the discharge orifice of said alignment member has an array of four circumferentially spaced lobes.

10. In a metal spray device of the arc spray type, alignment structure of electrically insulating material that defines a through passage, said alignment structure being disposed between a gas inlet and an arc zone such that a primary stream of gas is arranged to flow through said through passage, seat surfaces on the walls of said through passage, individual wire guides for each wire to be sprayed, each said wire guide being adapted to guide a metal wire therethrough towards an arc zone forward of said alignment structure, means for connecting said wire guides to a source of electric current for establishing an electric arc between the ends of the wires at said arc zone, a gas inlet for flowing a primary stream of gas through said through passage into the arc zone to cause molten metal particles to be carried from the arc zone for deposit on a substrate, and means for urging the tips of said wire guides outwardly away from one another to seat the tips of said wire guides on said seat surfaces of said alignment structure.

11. The device of claim 10 wherein each said wire guide includes an elongated electric-ally conductive tubular member and further including chamber defining structure that has a gas inlet, a gas outlet at its forward end, and two tubular member support ports at its rear end, each said tubular member being disposed in said chamber with the rear portion of each said tubular member extending through a corresponding support port for releasable connection to a terminal assembly external of said chamber defining structure, and means to seat said alignment structure against said forward end of said chamber defining structure such that said through passage is in communication with said gas outlet and the tips of said wire guides are seated on said seat surfaces of said alignment structure.

12. The device of claim 11 and further including structure defining a cylindrical support adjacent said gas outlet for supporting said alignment structure and permitting angular adjustment thereof to align said seat surfaces with said support ports.

13. An electric arc metal spray device comprising a body, individual wire guides for each wire to be sprayed, means for feeding a wire through each wire guide towards an arc zone forward of said body, means for connecting said wire guides to a source of electric current for establishing an electric arc between the ends of the wires at said arc zone, a gas inlet for flowing a primary stream of gas into the arc zone to cause molten metal particles to be carried from the arc zone, alignment structure of electrically insulating material that defines a through passage that terminates in a discharge orifice, said alignment structure being disposed between said gas inlet and said arc zone such that said primary stream flows through said through passage of said alignment structure, seat surfaces on the walls of said through passage, and means for urging the tips of said wire guides outwardly away from one another to seat the tips of said wire guides on said seat surfaces.

14. The device of claim 13 wherein said alignment structure further defining a gas flow channel between each said seat surface and said discharge orifice such that gas flow envelops each wire in that region as the wires are fed from the tips of said wire guides through said through passage to said arc zone.

15. The device of claim 13 and further including cap structure in juxtaposition to and cooperating with said alignment structure to define an annular passage adjacent said arc zone for a secondary gas stream that provides a constricting influence on the stream of molten particles carried from the arc zone by said primary stream.

16. The device of claim 13 and further including structure defining a gas supply chamber having an inlet port defining said gas inlet, an outlet port adjacent which said alignment structure is supported, and two support ports at the rear of said gas supply chamber, each said wire guide extending through a corresponding support port, and said connecting means includes a terminal member connected to each said wire guide external to each said support port such that each said wire guide has a degree of freedom of axial and angular movement in its support port.

17. The device of claim 16 and further including structure defining a cylindrical support adjacent said outlet port for supporting said alignment structure and permitting rotational adjustment thereof to align said seat surfaces with said support ports.

18. The device of claim 16 wherein each said wire guide is an elongated contact tube member with a replaceable end that includes a cylindrical tip portion, said alignment structure is a unitary nozzle-positioner member that is molded of plastics material and defines a converging through passage with the wire guide seats formed therein, and further including an air cap - arc shield assembly for securing said nozzle-positioner member on said chamber structure and providing a supplemental annular flow passage that extends around said nozzle-positioner member for flowing supplemental gas over the outside of said nozzle member in an annular converging stream towards said arc zone.

19. The device of claim 18 wherein said forwardly convergent passage of said nozzle-positioner member terminates in a discharge orifice that has a plurality of lobes.

* * * * *